US009610775B2

(12) United States Patent
Yanagida et al.

(10) Patent No.: US 9,610,775 B2
(45) Date of Patent: Apr. 4, 2017

(54) PRINTING APPARATUS

(71) Applicant: SEIKO EPSON CORPORATION, Tokyo (JP)

(72) Inventors: Eiko Yanagida, Shiojiri (JP); Nobuhisa Nomoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/215,459

(22) Filed: Jul. 20, 2016

(65) Prior Publication Data

US 2017/0043586 A1 Feb. 16, 2017

(30) Foreign Application Priority Data

Aug. 10, 2015 (JP) ..... 2015-157978

(51) Int. Cl.
*B41J 2/175* (2006.01)

(52) U.S. Cl.
CPC ..... *B41J 2/175* (2013.01)

(58) Field of Classification Search
CPC ..... B41J 2/17509
See application file for complete search history.

(56) References Cited

U.S. PATENT DOCUMENTS

2006/0119671 A1* 6/2006 Ha ..... B41J 2/17509 347/84
2014/0104349 A1* 4/2014 Kimura ..... B41J 2/17509 347/85
2016/0207318 A1* 7/2016 Shirono ..... B41J 2/175

FOREIGN PATENT DOCUMENTS

JP 2014-079908 5/2014

* cited by examiner

*Primary Examiner* — Geoffrey Mruk
*Assistant Examiner* — Scott A Richmond
(74) *Attorney, Agent, or Firm* — Workman Nydegger

(57) ABSTRACT

A printing apparatus includes a printing unit that performs printing onto a medium using liquid; a liquid housing body that includes a liquid pouring inlet that can pour the liquid into the liquid housing chamber; and a casing in which the printing unit and the liquid housing body are housed. The casing including a cover member that can displace the position thereof between an opening position which exposes the liquid pouring inlet to an outside and a closing position which does not expose the liquid pouring inlet to the outside, and the cover member can support an ink bottle in which liquid is stored in a state where the liquid can be poured from the ink bottle to the liquid pouring inlet of the liquid housing body in a case where the cover member is in the opening position.

11 Claims, 10 Drawing Sheets

PRINTING APPARATUS

BACKGROUND

1. Technical Field

The present invention relates to a printing apparatus that performs printing using a liquid supplied from a liquid housing body into which liquid such as ink is capable of being poured.

2. Related Art

As an example of a printing apparatus, an ink jet printer (for example, JP-A-2014-79908) is known. The ink jet printer includes a liquid housing body that has a liquid pouring inlet through which liquid such as ink to be used for printing is capable of being poured from outside and performs printing of an image or the like onto a medium by ejecting liquid supplied to a printing unit through a liquid supply tube or the like from the liquid housing body of the ink jet printer from the printing unit to the medium.

SUMMARY

Meanwhile, an operation of pouring liquid into a liquid housing body is performed by a user in the printer described above. In other words, the user grips a liquid pouring member of an ink bottle or the like in which liquid is stored with a hand, a distal end of the liquid pouring member of the ink bottle is introduced into a liquid pouring inlet of the liquid housing body and then the liquid pouring member is held by hand in order to hold a state where the distal end thereof is introduced into the liquid pouring inlet. According to this, a pouring operation of the liquid is performed. Therefore, in such a printer, further improvement in usability is demanded.

An advantage of some aspects of the invention is to provide a printing apparatus that improves the usability.

Hereinafter, means of the invention and operation effects thereof will be described.

According to an aspect of the invention, there is provided a printing apparatus including a printing unit that performs printing onto a medium using liquid; a liquid housing body that includes a liquid pouring inlet that is capable of pouring the liquid into the liquid housing chamber; and a casing in which the printing unit and the liquid housing body are housed. The casing includes a cover member that is capable of displacing the position thereof between an opening position which exposes the liquid pouring inlet to the outside and a closing position which does not expose the liquid pouring inlet to the outside. The cover member can support a liquid pouring member in which liquid is stored in a state where the liquid can be poured from the liquid pouring member to liquid pouring inlet of the liquid housing body in a case where the cover member is in the opening position.

According to the configuration described above, when the liquid is poured to the liquid housing body using the liquid pouring member, the cover member is in the opening position by the user, and then when the liquid pouring member is supported by the cover member in a state where the liquid can be poured to the liquid pouring inlet, the liquid is poured into the inside of the liquid housing chamber of the liquid housing body through the liquid pouring inlet from the liquid pouring member. In other words, users may not continue to hold the liquid pouring member by hand at the time of the pouring operation of the liquid. Therefore, usability by the user can be improved compared to the related art. In addition, the member that supports the liquid pouring member may be a support member provided in the casing and the support member also exhibits the same effect as described above in.

In addition, in the printing apparatus, preferably, a holding portion is provided on the cover member, and the holding portion is capable of holding the liquid pouring member on the cover member in a state where the liquid pouring member is aligned with the liquid pouring inlet in a case where the cover member is in the opening position.

According to the configuration described above, even if the liquid pouring member has, for example, a shape that is easy to roll as an ink bottle, since the liquid pouring member can be held by the holding portion so as to be aligned with the liquid pouring inlet and thus the rolling can be restricted, the pouring operation of the liquid can be stably performed.

In addition, in the printing apparatus, preferably, an engaging mechanism is on the casing, and the engaging mechanism engages the cover member so that the support member or the cover member displaced from the closing position to opening position is capable of being restricted from being displaced in a further opening direction from the opening position.

According to the configuration described above, when the support member or the cover member supports the liquid pouring member in the opening position at the time of an pouring operation of the liquid, and the support member or the engaging member is stably held in the opening position by the engaging member being engaged with the support member or the cover member. Therefore, even if the user does not hold a hand on the liquid pouring member, the liquid pouring member can be stably supported by the support member or the cover member being held in the opening position.

In addition, in the printing apparatus, preferably, the engaging mechanism is configured to be capable of engaging to the cover member in a plurality of opening positions in which an angle to the vertical line varies.

According to the configuration described above, since the opening position of the support member or the cover member can be selected from the plurality of the opening positions by the determination of the user, the pouring operation of the liquid can be efficiently performed according to operation circumstances.

In addition, preferably, the printing apparatus includes a biasing member that biases the support member or the cover member from the opening position in a closing position direction.

According to the configuration described above, since the support member or the cover member is biased to the closing position direction by the biasing force of the biasing member, a concern that the cover member in the closing position is carelessly opened is reduced.

In addition, in the printing apparatus, preferably, an angle between a surface that supports the liquid pouring member and the vertical line in a case where the support member or the cover member is in the opening position and an angle between a surface on which the liquid pouring inlet in the liquid housing body which is in a state of being housed in the casing is formed and the vertical line are in a relationship of a complementary angle.

According to the configuration described above, when the liquid pouring member is supported on the support member or the cover member in the opening position, the distal end of the liquid pouring member is positioned so as to be straightforwardly inserted into the liquid pouring inlet of the liquid housing body, and thus the pouring operation of the liquid becomes easy.

In addition, in the printing apparatus, preferably, a transparent window is provided on a side wall that is positioned on the low side of the cover member in the casing, and the liquid housing body housed in the inside of the casing is visibly recognized, through the transparent window.

According to the configuration described above, for example, in a case where the liquid housing body has the visible recognition portion in which the remaining amount of the liquid in the inside of the liquid housing chamber can be visibly recognized, whether or not the pouring operation of the liquid is needed can be easily determined by the remaining amount of the liquid being visibly recognized through the transparent window of a side wall and the visible recognition portion of the liquid housing body from the outside of the casing.

In addition, in the printing apparatus, preferably, a flow restricting unit is provided in the position that is higher than that of the transparent window in the side wall, and the flow restricting unit restricts the liquid from flowing downwardly in the vertical direction.

According to the configuration described above, since the liquid that is leaked at the time of liquid pouring is restricted from flowing to the rear side of the transparent window in the side wall by the flow restricting unit, the contamination of the transparent window or the contamination of the liquid housing body by the liquid leaked can be reduced.

In addition, in the printing apparatus, preferably, the liquid pouring member includes a pouring outlet portion for pouring out the liquid to the liquid pouring inlet, an air introduction portion for introducing air that is provided to the side opposed to the side on which the pouring outlet portion is provided, and a cover member that is capable of sealing the air introduction portion and is operated to release sealing of the air introduction portion when the liquid is poured out to the liquid pouring inlet.

According to the configuration described above, when the cover member is operated for the sealed state of the air introduction portion to be released after the liquid pouring member is supported by the cover member in the opening position in a state where the pouring of the ink to the liquid pouring inlet can be performed, the air from the air introduction portion is introduced in the inside of the liquid pouring member. For this reason, even if pressure is not applied to the liquid pouring member from the outside, the liquid from the liquid pouring out portion is likely to be poured out, and pouring times of the liquid to the liquid housing body can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a multifunction machine which includes a printing apparatus will be described in detail with reference to the drawings. For example, a printing apparatus of the present embodiment includes an ink jet type of a printer that performs printing by ink which is an example of liquid injected onto paper which is an example of a medium. In addition, the printer is a so called serial type of a printer that performs the printing by moving a liquid ejection head that functions as a printing unit in a main scanning direction intersecting with a transport direction of the paper. Hereinafter, a direction along a transport direction of the paper is referred to as "a longitudinal direction", a main scanning direction in which the printing unit moves at the time of the printing is referred to as "a lateral direction", and thus a vertical direction along the gravity direction is referred to as "an upper and lower direction".

Figure 1:
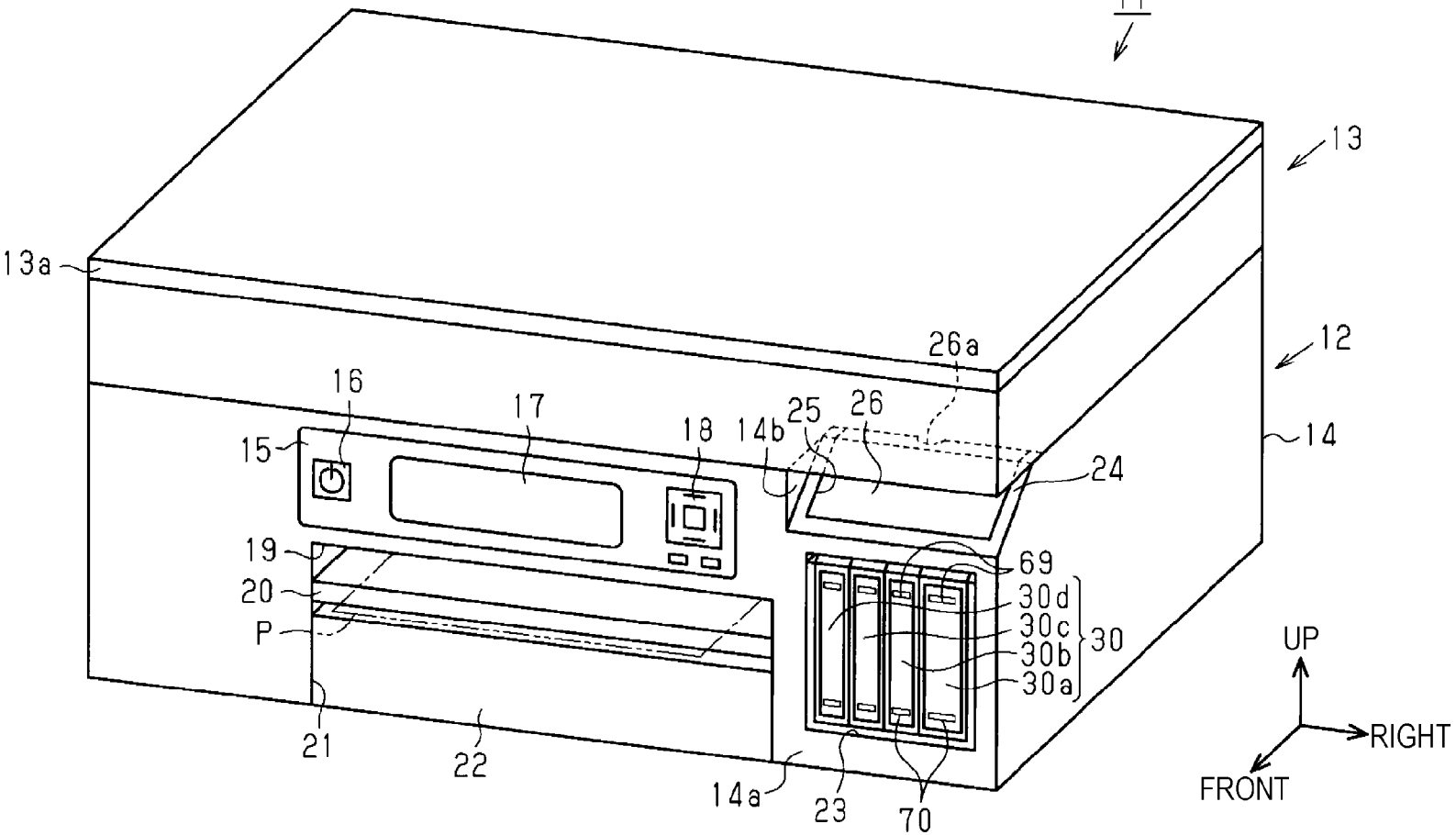
FIG. 1 is a perspective view illustrating a multifunction machine including a printing apparatus.

As illustrated in FIG. 1, the multifunction machine 11 includes a printing apparatus 12 having a printing function, and an image reading device 13 having a reading function. The printing apparatus 12 has a rectangular parallelepiped casing 14 and the image reading device 13 is disposed on the casing 14. The casing 14 of the printing apparatus 12 and the image reading device 13 have a substantially matched shape with each other when viewed from above.

An operation panel portion 15 for operating various operations in the multifunction machine 11 is provided in a position which is substantially the center in a lateral direction at the upper portion of the front surface of the casing 14 in the printing apparatus 12. The operation panel portion 15 includes, for example, a power button 16, a touch panel type of a liquid crystal display screen 17, an operation button 18, or the like, and has a horizontally elongated rectangular shape in a case when viewed from the front surface side which is the near side of the user's hand.

In addition, in the front surface side of the casing 14 in the printing apparatus 12, in a position which is a lower side of the operation panel portion 15, a rectangular discharge port 19 that discharges the paper P printed at the inside of the casing 14 of the printing apparatus 12 to the front side is opened. A rectangular plate-like discharge tray 20 that supports the paper P discharged from the discharge port 19 is provided to be capable of sliding to be moved in the longitudinal direction which is the discharge direction below of the discharge port 19.

A cassette mounting portion 21 is provided in the lower side of the discharge tray 20 in the front surface of the casing 14, and a paper feed cassette 22 capable of housing in a state of being stacked a plurality of sheets of paper P to be used for the printing is mounted in the cassette mounting portion 21 in an insertable manner in the longitudinal direction.

Further, the front end of the paper feed cassette 22 is formed to have a size so as to be substantially in the same position as the front surface of the casing 14 in the longitudinal direction in the case where the paper feed cassette 22 is mounted on the cassette mounting portion 21.

In addition, as illustrated in FIG. 1, a rectangular transparent window 23 which is formed of glass or transparent resin material, for example, is provided in a position which is an end portion side (right end portion side in FIG. 1) of the cassette mounting portion 21 of a front surface side wall 14*a* in the casing 14 of the printing apparatus 12 in the lateral direction. Accordingly, a liquid supply unit 29 having a size of which the upper and lower direction and the lateral direction thereof substantially correspond to the sizes of the upper and lower direction and the lateral direction of the transparent window 23 is housed at the position which is a rear side of the transparent window 23, that is at the position which is near the front surface or near the end portion (in this case, near right end portion) in the inside of the casing 14 of the printing apparatus 12. The liquid supply unit 29 is a structure body that can be handled in an integral manner by including the plurality of the liquid housing bodies 30 (30*a* to 30*d*) (four liquid housing bodies in the present embodiment), and as described below, the ink can be poured into each of the liquid housing bodies 30*a* to 30*d*.

Figure 2:
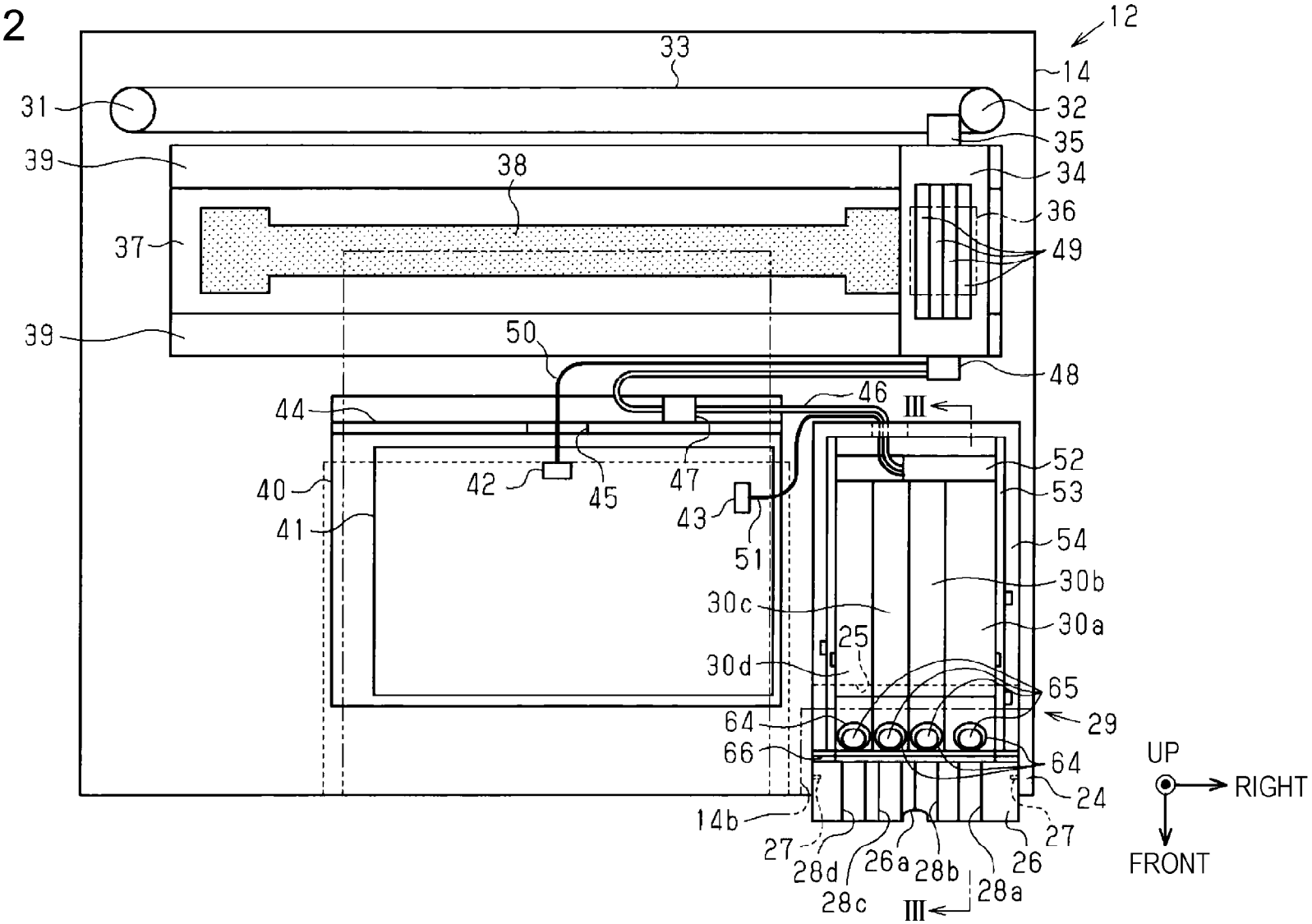
FIG. 2 is a plan view illustrating an internal structure of a printing apparatus of a first embodiment.

In addition, as illustrated in FIG. 1 and FIG. 2, an inclined portion 24 having a gradient in which a front side is lowered is formed in the position of an upper side of the transparent window 23 of the front surface side wall 14*a* in the casing 14 of the printing apparatus 12. Accordingly, a rectangular opening portion 25 is formed on the inclined portion 24, and a cover member 26 is provided in the opening portion 25, and the cover member 26 can be displaced between a closing position (see FIGS. 1 and 3) in which the opening portion 25 is closed and an opening position (see FIGS. 2 and 4) in which the opening portion 25 is opened. In other words, in the position facing the opening portion 25 at the lower end near the inclined portion 24 of the casing 14, a pair of right side and left side rotating shafts 27 (see FIG. 2) is provided in the lateral direction, and a proximal end portion of the cover member 26 is rotatably supported about the rotating shafts 27 of the cover member 26. For this reason, the cover member 26 is opened and closed between the closing position and the opening position by rotating about the rotating shafts 27.

In addition, in FIG. 2, the inclined portion 24 and the opening portion 25 in the casing 14 is illustrated by two-dot chain lines, and in the cover member 26, the cover member 26 in a case where the cover member 26 is in the opening position is illustrated by solid lines when viewed from above. A finger hook portion 26*a* is cut out in a substantially central position of the leading end edge of the cover member 26 along the lateral direction of the cover member 26 so that a finger tip of a user hangs in the finger hook portion 26*a* when the cover member 26 is displaced from the closing position to the opening position. Further, a plurality of concave grooves 28 (28*a* to 28*d*) (four concave grooves 28 in the present embodiment) is formed along the longitudinal direction in the rear surface of the cover member 26 (in other words, as illustrated in FIG. 2, surface facing upward when the cover member 26 is in the opening position). In this connection, each of the concave grooves 28 (28*a* to 28*d*) is provided so that each of the concave grooves is positioned on the same line in the longitudinal direction with each of the liquid housing bodies 30 (30*a* to 30*d*) disposed in parallel in the lateral direction on the rear side of the transparent window 23.

As illustrated in FIG. 2, a driven pulley 31 is provided in a rear surface near position and in a left near position in the inside of the casing 14 of the printing apparatus 12, and a drive pulley 32 that can rotate to be driven by a motor (not illustrated) is provided in the same rear position and in the same right position as the driven pulley 31. An endless timing belt 33 is wound around the both pulleys 31 and 32 and a portion of the timing belt 33 is connected to a connection portion 35 provided in a rear portion of the carriage 34. In addition, a liquid ejection head 36 which is an example of a printing unit that performs the printing by ejecting a plurality of colors of ink (four colors in the present embodiment) onto the paper P is mounted in the lower surface side of the carriage 34.

In addition, a rectangular support platform 37 is disposed which is long in the lateral direction perpendicular to the longitudinal direction which is a transport direction of the paper P in a position which is a front side of the timing belt 33 in the inside of the casing 14 of the printing apparatus 12. The support platform 37 is a platform which supports the bottom surface of the paper P when the paper P is transported in the transport direction at the time of the printing. A porous ink absorbing member 38 is exposed over a substantially rectangular region which is long in the lateral direction in the surface facing the liquid ejection head 36 in the support platform 37. Accordingly, a pair of front and rear rails 39 that extend in the lateral direction is provided to movably support the carriage 34 in the front side and rear side of the support platform 37. Therefore, when the drive pulley 32 is rotated by driving the motor, the driving force of the drive pulley is transmitted to the connection portion 35 through the timing belt 33 and the carriage 34 reciprocates in the lateral direction by guiding the pair of front and rear rails 39.

In addition, a rectangular support frame portion 40 is provided in a position that is a front side of the front side rail 39 in the casing 14 of the printing apparatus 12 and a circuit board 41 that functions as a control unit including a CPU or the like is supported on the support frame portion 40. A plurality of connectors 42 and 43 (in the present embodiment, as an example, only two connectors are illustrated) are fixed to the upper of the circuit board 41. In addition, a vertical guide wall 44 that extends along the lateral direction and is lengthened is formed in a portion near a rear end edge along a long side of the rear portion side of the circuit board 41 in the support frame portion 40.

A cut-out concave portion 45 is formed in the portion which becomes substantially the center in the lateral direction of the guide wall 44. Accordingly, a fixing member 47 is provided that fixes a middle portion of a liquid supply tube 46 which has flexibility and connects an end of the guide wall to the liquid supply unit 29 in the rear surface of the guide wall 44 which is the carriage 34 side nearer to a right end portion than a cut-out concave portion 45 of the guide wall. The other end side portion of the fixing member 47 in the liquid supply tube 46 is folded after the other end side portion of the fixing member extends along the rear surface of the guide wall 44, and the other end of the guide wall 44 is connected to each sub tank 49 mounted on the carriage 34 via the connection portion 48 provided to a front portion of the carriage 34.

The sub tank 49 temporarily stores each ink supplied by the liquid supply tube 46 and supplies the ink to the liquid ejection head 36. In this case, the liquid supply tube 46 may be connected to the liquid ejection head 36 via an adapter (not illustrated) without the sub tank 49 being mounted on the carriage 34. In addition, the plurality of liquid supply tubes 46 (four liquid supply tubes 46 in this embodiment) in which the number thereof is equal to the number of the plurality of the liquid housing bodies 30*a* to 30*d* (four liquid housing bodies in this embodiment) which is included the liquid supply unit 29 is routed. However, for simplification of the drawing in FIG. 2 or the like, three liquid supply tubes 46 of four liquid supply tubes 46 are omitted and only one liquid supply tube 46 is illustrated in FIG. 2 or the like. Further, these four liquid supply tubes may be constituted by four consecutive tubes formed integrally with each other.

In addition, a signal line 50 which has one end side connected to the liquid ejection head 36 or the like is derived from the connection portion 48 of the carriage 34. The other end side of the signal line 50 extends along the rear surface of the carriage 34 side in the guide wall 44, passes through cut-out concave portion 45, and then is connected to the circuit board 41 through a connector 42. In addition, the other end side of the signal line 51 which has one end side connected to the liquid supply unit 29 is connected to the other connecter 43 on the circuit board 41.

Next, the liquid supply unit 29 that functions as the liquid supply device supplying the ink into the liquid ejection head 36 in the printing apparatus 12 will be described.

Figure 3:
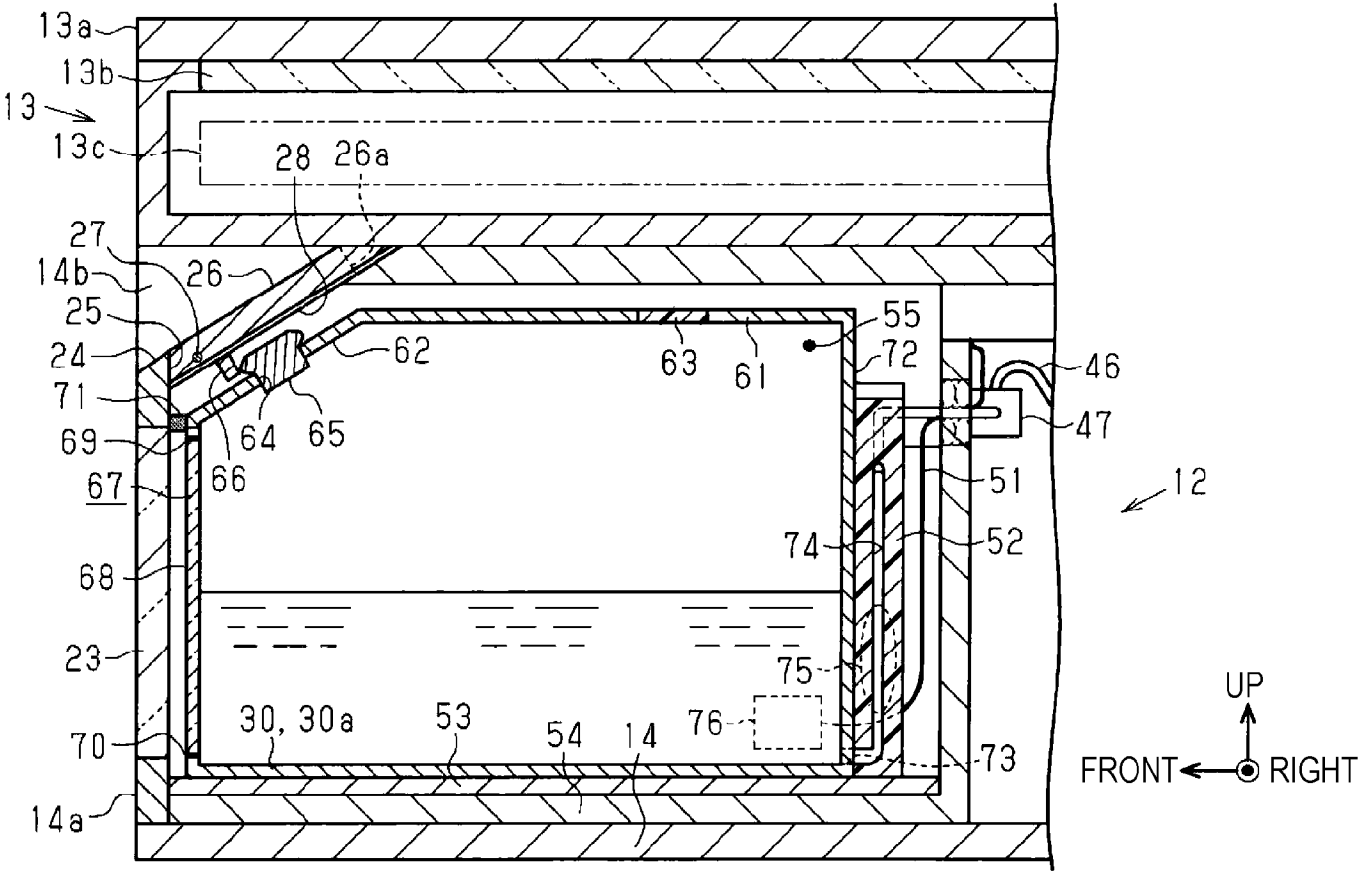
FIG. 3 is a partial sectional view taken along arrow line III-III of FIG. 2.

As illustrated in FIGS. 2 and 3, the liquid supply unit 29 includes a plurality of liquid housing bodies 30*a* to 30*d*, a flow path forming member 52 of which an ink flow path connected to the liquid housing bodies 30*a* to 30*d* is formed in the inside thereof, and a set member 53 that sets together with the flow path forming member 52 in a state arranged so as to overlap the plurality of the liquid housing bodies 30*a* to 30*d* in their thickness direction with each other. Accordingly, the liquid supply unit 29 is supported in a state that can be integrally handled by the plurality of the liquid housing bodies 30*a* to 30*d* being set together with the flow path forming member 52 to the set member 53 and in a state that is positioned to the holding member 54 fixed at a position near the front surface and near the right end portion in the inside of the casing 14.

The plurality of the liquid housing bodies 30*a* to 30*d* includes a liquid housing body 30*a* in which black ink is housed, a liquid housing body 30*b* in which cyan ink is housed, a liquid housing body 30*c* in which magenta ink is housed, and a liquid housing body 30*d* in which yellow ink is housed. These four liquid housing bodies 30*a* to 30*d* are set in the inside of the set member 53 with an aspect that the longitudinal direction of each of liquid housing bodies 30*a* to 30*d* follows from the front surface side to the front and rear direction which is a depth direction of the casing 14 and in a side by side state in the lateral direction which is a main scanner direction when the liquid ejection head 36 is printed on the paper P. Accordingly, the black ink liquid housing body 30*a* having a greater capacity than the other three liquid housing bodies 30*b* to 30*d* is set to be positioned on the rightmost end side in the lateral direction illustrated in FIG. 2 in a case where the liquid housing body is attached to the inside of the casing 14 of the printing apparatus 12. In addition, each liquid housing body may be the same size.

The plurality of the liquid housing bodies 30*a* to 30*d* are an ink tank having a substantially rectangular parallelepiped shape in which the lateral direction along an alignment direction of the plurality of the liquid housing bodies is a thickness direction, a height direction along the vertical direction is a transverse direction, the front and rear direction of the casing 14 along the transport direction of the paper P is a longitudinal direction at a state of being disposed in parallel in the inside of the casing 14 through the set member 53 or the like, and a liquid housing chambers 55 in which ink can be housed is included in the inside of the liquid housing bodies. When the liquid housing bodies 30*a* to 30*d* are disposed in parallel in the inside of the casing 14 through the set member 53 or the like, a surface facing the upper side of the vertical direction includes a rectangular horizontal plane portion 61 along the longitudinal direction and an inclined surface portion 62 of a gradient in which a front side is lowered and which continues to the front end of the horizontal plane portion 61 of the liquid housing body.

An atmosphere communicating portion 63 in which the atmosphere communicates with the inside of the liquid housing chamber 55 is provided in the horizontal plane portion 61. Further, the atmosphere communicating portion 63 is configured with a narrow flow path structure that is referred to as a snake shaped groove formed by an elongated meandering groove, for example, and is made of a waterproof moisture-permeable material or the like in which a passage of gas such as air is acceptable while the passage of the liquid is restricted. On the other hand, the inclined surface portion 62 is positioned near the upper side of a transparent window 23 that is formed on a front surface side wall 14*a* of the casing 14 and is inclined so as to face a lower side of a vertical direction by being connected near the front surface side wall 14*a* of the casing 14, in a state where the liquid housing body 30 is set in the inside of the casing 14 through the set member 53. Accordingly, a liquid pouring inlet 64 which can pour ink from the outside in the inside of the liquid housing chamber 55 is formed in the inclined surface portion 62. In addition, the liquid pouring inlet 64 is normally closed by a plug 65 of rubber or the like.

As illustrated in FIG. 3, the inclined surface portion 62 of the liquid housing body 30 is positioned to the rear surface side of the inclined portion 24 formed on the upper portion of the front surface side wall 14*a* in the casing 14 in a case where the liquid housing body 30 is disposed to in the inside of the casing 14. Accordingly, the liquid pouring inlet 64 formed on the inclined surface portion 62 of the liquid housing body 30 is not exposed to the outside by being concealed by the cover member 26 in a case where the cover member 26 provided to an opening portion 25 of the inclined portion 24 is in a closing position closing the opening portion 25. On the other hand, in a case where the cover member 26 is in an opening position opening the opening portion 25, the liquid pouring inlet 64 formed on the inclined surface portion 62 of the liquid housing body 30 is exposed to the outside through the opening portion 25 in order not to be concealed by the cover member 26. In other words, the cover member 26 has a structure that is capable of displacing the position thereof between an opening position which exposes the liquid pouring inlet 64 to the outside and a closing position which does not expose the liquid pouring inlet 64 to the outside.

In addition, in the inside of the casing 14, in the position that is the rear side of the cover member 26 which is in a closing position, a rod-shaped engaging member 66 extending in the left and right direction parallel with the rotating shaft 27 is provided as an example of an engagement mechanism engaged in a case where the cover member 26 is displaced to an opening position from the closing position. In other words, the engaging member 66 is provided in order to extend in the lateral direction in the inside of an area through which a proximal end portion of the cover member 26 passes when the cover member 26 is rotated about a rotating shaft 27. For that reason, the engaging member 66 is engaged from the front side of the rotating direction to the proximal end portion of the cover member 26 and restricts the cover member 26 from rotating in the direction from the opening position to a further opening position when the cover member 26 is displaced from the closing position to the opening position.

In addition, in the liquid housing bodies 30*a* to 30*d* a visible recognition portion 68 formed of a transport resin or the like that can visibly recognize the liquid surface of the ink of the inside of the liquid housing chamber 55 in the front wall portion 67 that is a wall portion facing the front surface side wall 14*a* in a front and rear direction in which the transparent window 23 is formed in the casing 14. An upper limit portion 69 indicating a pouring upper limit of the ink to the liquid housing chamber 55 and a lower limit portion 70 indicating a lower limit level of a remaining ink amount in the inside of the liquid housing chamber 55 are provided in the visible recognition portion 68. Accordingly, an ink absorption material 71 is provided between the upper side position of the transparent window 23 in the front surface side wall 14*a* of the casing 14 and the upper side position of the visible recognition portion 68 in front wall portion 67 of the liquid housing bodies 30*a* to 30*d*. In this case, the ink absorption material 71 functions as a restriction portion that restricts the ink which is on the upper side of the ink absorption material from flowing to a vertically downward position which is the visible recognition portion 68 and the transparent window 23.

Further, as illustrated in FIG. 3, the upper area of the inclined portion 24 of the casing 14 is covered by a portion near a front surface and near a right end portion in the image reading device 13 supported on the casing 14. In this connection, the upper surface of the image reading device 13 is covered by a document cover 13*a* that can open and close, the image of the document (not illustrated) stacked at a glass plate 13*b* that forms the upper surface of the image reading device is read by an image scanner 13*c* provided on the lower side of the glass plate 13*b*, and a read image of the document is transmitted to the circuit board 41.

In addition, a liquid supply port 73 that supplies the ink from the liquid housing chamber 55 to the outside is formed on the lower end portion of a rear wall portion 72 in the liquid housing bodies 30*a* to 30*d*. Accordingly, a flow path forming member 52 is joined to the rear wall portion 72 of the liquid housing bodies 30*a* to 30*d* in order to supply the ink from the liquid supply port 73. The flow path forming member 52 is a plate shape member formed to have a predetermined thickness with a resin material or the like, and a flow path 74 is formed in the inside of the flow path forming member 52, and the flow path 74 causes the ink supplied from the liquid supply port 73 of the liquid housing bodies 30*a* to 30*d* to flow toward the liquid supply tube 46. Further, a pump 75 made of a diaphragm or the like in the middle of the flow path 74 illustrated by dashed lines in FIG. 3 is provided in the inside of the flow path forming member 52, and the ink is supplied from the liquid housing bodies 30*a* to 30*d* side to the liquid ejection head 36 side by the drive of the pump 75.

As illustrated in FIG. 3, a remaining amount detecting unit 76 is provided in the liquid housing body 30 so as to detect a remaining amount of the ink in the inside of the liquid housing chamber 55. The remaining amount detecting unit 76 includes a photo interrupter or the like having a light-emitting element and a light-receiving element, for example, the remaining amount detecting unit 76 is provided for each of the four liquid housing bodies 30*a* to 30*d*. Accordingly, when the detecting signal indicating that the remaining amount of the ink in the inside of the liquid housing chamber 55 from the remaining amount detecting unit 76 is in a near end state (close exhaustion) and is transmitted to the circuit board 41, a message prompting the pouring of the ink to a liquid crystal display screen 17 in the operation panel portion 15 of a front surface of the casing 14 is displayed.

So then, an action of the printing apparatus 12 constructed as described above, in particular an action in a case where the ink is poured from the liquid pouring inlet 64 to the liquid housing chamber 55 of the liquid housing body 30 is mainly described below.

Now, the user performs a pouring operation of the ink to the liquid housing chamber 55 in which the ink remaining amount is in a near-end state, in a case where the user recognizes that the ink remaining amount of the liquid housing chamber 55 of the liquid housing body 30 by a notification message is in the near-end state, or the like of the liquid crystal display screen 17 based on the detecting result of the remaining amount detecting unit 76. Further, in the following, a case in which the ink is poured in the liquid housing body 30 (30*a*) which is disposed in the rightmost side when viewed from the front surface side and is a larger capacity type than the other three liquid housing bodies 30*b* to 30*d*, among the four liquid housing bodies 30 (30*a* to 30*d*) will be described as an example.

Figure 4:
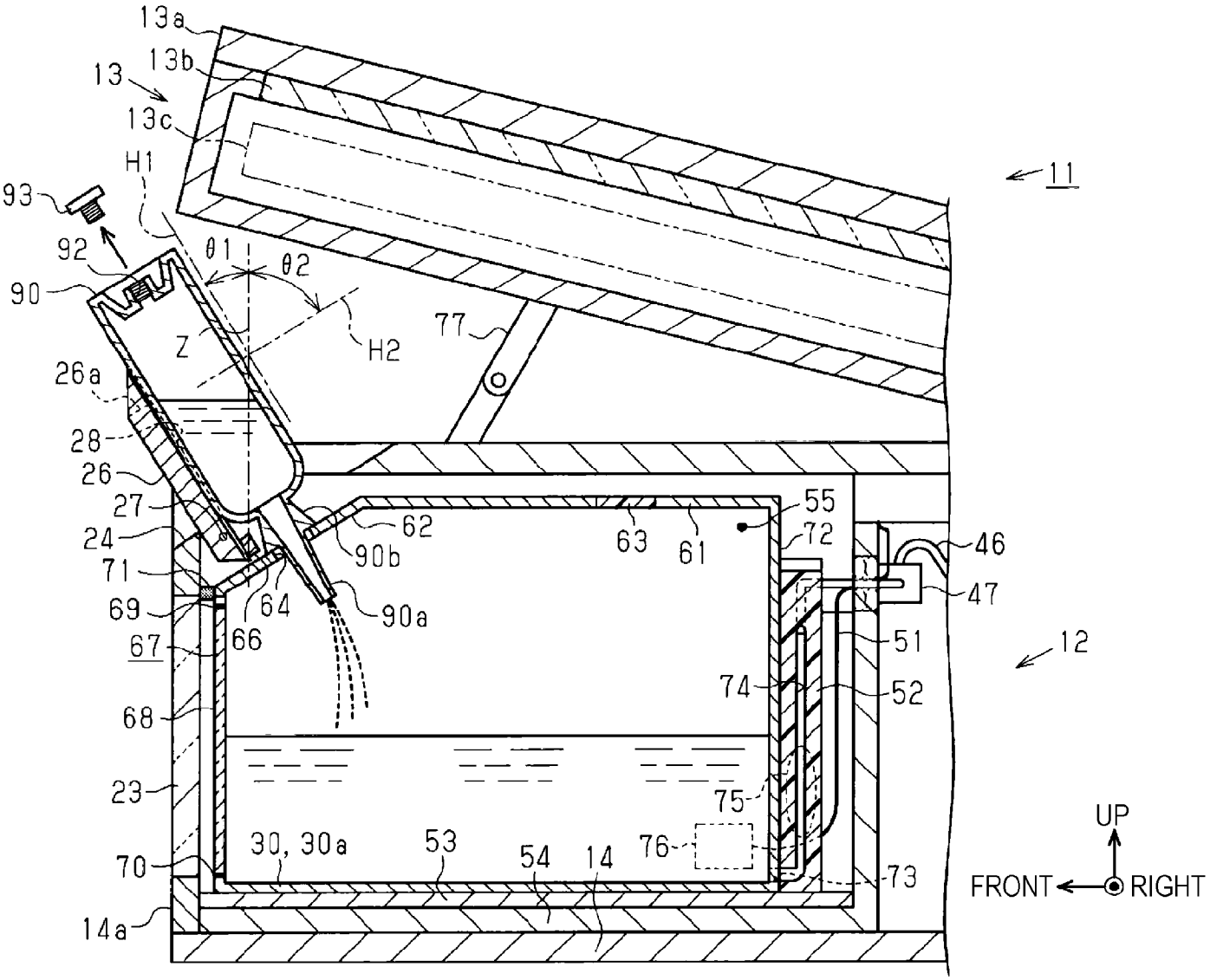
FIG. 4 is a partial sectional view when liquid is poured to a liquid housing body in the printing apparatus.

As illustrated in FIG. 4, in a case where an ink pouring operation is performed, first, the user causes a hinge (illustrated) in which the image reading device 13 supported on the upper surface of the casing 14 is provided on the rear portion of the casing 14 as a supporting point to be inclined so that a front end side of the image reading device 13 is raised. After that, a state where the image reading device 13 supported by a link member 77 is inclined so that a front portion of the image reading device 13 is raised is held. Then, since the upper side area of the inclined portion 24 in which the cover member 26 is provided is largely opened in the casing 14, the user can perform the opening operation of the cover member 26 by hooking their finger tip into a finger hook portion 26*a* of the cover member 26 in the closing position and pulling it to the front side. Then, the cover member 26 is rotated from the closing position illustrated in FIG. 3 to the opening position illustrated in FIG. 4, and then a plug 65 from the liquid pouring inlet 64 is removed and then the ink can be poured from the liquid pouring inlet 64 opened to the inside of the liquid housing chamber 55.

At this time, a proximal end portion of the cover member 26 is engaged with the engaging member 66 in the opening position and a rotating displacement of the cover member 26 to a more open direction is restricted.

Accordingly, the cover member 26 is held at a stable opening position by engaging with the engaging member 66. At this point, the engaging member 66 that engages with the cover member 26 functions as an engaging mechanism that engages the cover member 26 in a method capable of restricting the cover member 26 from being displaced from the opening position to further opening position.

And then, an ink bottle 90 that is an example of the liquid pouring member in which ink for pouring is stored is disposed on the rear surface (the surface facing the inclined upper side in FIG. 4) of the cover member 26 in a state where the cover member 26 as described above is in the opening position. Further, as an example, the ink bottle 90 according to the present embodiment has a distal end portion of the ink bottle 90 that is formed in an elongated pouring outlet portion 90*a* which extends along the central axis of the body, together with the body portion that has a cylindrical shape. Accordingly, a rib-like stopper portion 90*b* that is in contact with the peripheral edge of the liquid pouring inlet 64 of the inclined surface portion 62 of the liquid housing body 30

(30*a*) is formed around the pouring outlet portion 90*a* in a case where the pouring outlet portion 90*a* is inserted into the liquid pouring inlet 64 of the liquid housing body 30 (30*a*).

On the other hand, in the ink bottle 90, an air introduction portion 92 that can introduce air in the ink bottle 90 is formed in the proximal end portion (that is, the bottom portion of the ink bottle 90) of the side opposite to the side provided with the pouring outlet portion 90*a*. As an example, the air introduction portion 92 is constructed by the female screw hole in the present embodiment. Accordingly, a cover member 93 that can seal the air introduction portion 92 is usually mounted on the air introduction portion 92. In this connection, as illustrated in FIG. 4, when the ink is poured out into the liquid pouring inlet 64, the cover member 93 is operated in order to release the seal of the air introduction portion 92 by the user. As an example, the cover member 93 is constructed by a spring type cover in which the female screw portion is formed in the present embodiment. Accordingly, the seal of the air introduction portion 92 is released by removing the cover member 93 that has the female spring portion from the air introduction portion 92 having the female spring hole and thus the pouring out of the ink from the pouring outlet portion 90*a* is prompted at the time of the ink pouring.

As illustrated in FIG. 4, the ink bottle 90 that is mounted on the rear surface of the cover member 26 in the opening position is engaged with a concave groove 28 of the body portion. In this case, since there is a pouring operation of the liquid to the liquid housing body 30*a* which is disposed in the rightmost side in FIG. 2, the ink bottle 90 is also engaged with the most right-hand side of the concave groove 28*a* in FIG. 2. Then, the ink bottle 90 is restricted from rolling sideways by the body portion engaging the concave groove 28*a* and the proximal end of the pouring outlet portion 90*a* is held in a state aligned with the liquid pouring inlet 64 of the most right-hand side of the liquid housing body 30*a*. In other words, since the body portion of the ink bottle 90 of the invention has a cylindrical shape, the ink bottle 90 is likely to be rolled when the ink bottle 90 is disposed on the rear surface of the cover member 26. However, the concave groove 28 (28*a*) is engaged in order to restrict rolling with respect to the peripheral surface of the body portion of the ink bottle 90. At this point, the concave grooves 28 (28*a* to 28*d*) function as a holding portion by which the ink bottle 90 can be held in a state aligned with the liquid pouring inlet 64 on the cover member 26 in a case where the cover member 26 is in an opening position.

In addition, as illustrated in FIG. 4, in a case where the proximal end portion of the cover member 26 is engaged with the engaging member 66 in an opening position, an angle between a line H1 parallel to the rear surface on which the concave groove 28 being in a surface which supports the ink bottle 90 in the cover member 26 is formed and the vertical line Z is an angle θ1 which is an acute angle (for example, 30 degrees). On the other hand, an angle between a line H2 parallel to the inclined surface portion 62 which is in a surface on which the liquid pouring inlet 64 is formed in the liquid housing body 30 (30*a*) in a state housed in the casing 14 and the vertical line Z is an angle θ2 which is the same acute angle (for example, 60 degrees). Then, the open angle at the opening position of the cover member 26 in the present embodiment and the angle of inclination of the inclined surface portion 62 of the liquid housing body 30 (30*a*) are set so that the angle θ1 and the angle θ2 in this case have the relationship of a supplementary angle with each other.

For that reason, on the cover member 26 which is in the opening position, the ink bottle 90 that is held in a state aligned with the liquid pouring inlet 64 by the body portion of the cover member 26 being engaged with the concave grooves 28 (28*a* to 28*d*) is in a state where the central axis of the pouring outlet portion 90*a* of the proximal end of the ink bottle is perpendicular to the inclined surface portion 62 on which the liquid pouring inlet 64 of the liquid housing body 30 (30*a*) is formed. Accordingly, in this state, when the ink bottle 90 is slid diagonally downward along the concave groove 28 (28*a* to 28*d*) of the rear surface of the cover member 26, the pouring outlet portion 90*a* of the ink bottle 90 is inserted into the liquid pouring inlet 64 of the liquid housing body 30 (30*a*) and then the stopper portion 90*b* of the ink bottle 90 is in contact with the inclined surface portion 62 of the liquid housing body 30 (30*a*). As a result, as described in FIG. 4, even if the ink bottle 90 is not held by the hands of the user, the pouring outlet portion 90*a* is held in a state of being inserted into the liquid pouring inlet 64 of the liquid housing body 30 (30*a*) and the ink is poured from the inside of the ink bottle 90 to the inside of the liquid housing chamber 55 of the liquid housing body 30 (30*a*).

Further, at the time of the pouring operation, the user can visually recognize the change of the liquid surface of the ink in the inside of the liquid housing chamber 55 through the visible recognition portion 68 of the front wall portion 67 in the liquid housing body 30 (30*a*). Accordingly, when the height of the liquid surface of the ink in the inside of the liquid housing chamber 55 is raised to the upper limit portion 69 marked on the upper portion of the visible recognition portion 68 after the start of the pouring of the ink, the user withdraws the pouring outlet portion 90*a* of the ink bottle 90 from the liquid pouring inlet 64, and then blocks the liquid pouring inlet 64 again by the plug 65. Accordingly, when the cover member 26 in a state of the opening position is rotated to be displaced up to the closing position, each of the liquid housing bodies 30 (30*a* to 30*d*) arranged in parallel in the inside of the casing 14 is in a state where each of the liquid housing bodies 30 (30*a* to 30*d*) is not exposed to the outside by the liquid pouring inlet 64 being concealed from the front side by the cover member 26 and thus the pouring operation of the ink is ended.

in the pouring operation of the ink as described above, the ink cannot be poured well from the pouring outlet portion 90*a* of the ink bottle 90 to the inside of the liquid pouring inlet 64 of the liquid housing body 30 (30*a*), and there is a case where the ink is leaked around the liquid pouring inlet 64 by mistake. In such a case, the ink leaked flows along the visible recognition portion 68 of the front wall portion 67 from the inclined surface portion 62 of the liquid housing body 30 (30*a*). For this reason, the upper limit portion 69 (and the lower limit portion 70) marked on the visible recognition portion 68 may become dirty.

At this point, in a case of the present embodiment, an ink absorption material 71 is provided between the upper side position of the transparent window 23 in the front surface side wall 14*a* of the casing 14 and the upper side position of the visible recognition portion 68 in the front wall portion 67 of the liquid housing bodies 30*a* to 30*d* absorbs the ink flowing from the inclined surface portion 62 of the liquid housing body 30 (30*a*) to the lower side along the front wall portion 67. For this reason, the transparent window 23 in the front surface side wall 14*a* of the casing 14 or the visible recognition portion 68 of the liquid housing body 30 (30*a*) is restricted from being contaminated by the ink leaked at the time of the pouring operation of the ink.

According to the printing apparatus 12 of the present embodiment described below, the following effects can be obtained.

(1) The ink can be poured to the liquid housing body 30 using the ink bottle (the liquid pouring member) 90 and the user moves the cover member 26 to the opening position, and then when the ink bottle 90 is supported by the cover member 26 in a state where the ink can be poured to the liquid pouring inlet 64, the ink is poured in the inside of the liquid housing chamber 55 of the liquid housing body 30 through the liquid pouring inlet 64 from the ink bottle 90. In other words, users may not continue to hold the ink bottle 90 by hand at the time of the pouring operation of the ink. Therefore, the ink is restricted from being attached to the user's hand at the time of the pouring operation of the ink, for example, and usability by the user can be improved compared to the related art.

(2) Even if the ink bottle (the liquid pouring member) 90 has a shape that is easy to roll, since the rolling can be restricted by holding the ink bottle 90 in a state where the ink bottle 90 is aligned with the liquid pouring inlet 64 by the concave groove (holding portion) 28 formed on the rear surface of the cover member 26 which is a surface supporting the ink bottle 90, the pouring operation of the ink can be stably performed.

(3) The cover member 26 can support the ink bottle 90 in the opening position at the time of the pouring operation of the ink, and the engaging member 66 is stably held in the opening position by the engaging member 66 being engaged with the cover member 26. Therefore, even if the hand of the user does not reach the ink bottle 90, the ink bottle 90 can be stably supported by the cover member 26 held at the opening position.

(4) the ink bottle 90 can be supported on the cover member 26 in the opening position, the distal end of the elongated pouring outlet portion 90*a* of the ink bottle 90 is positioned so as to be straightforwardly inserted into the liquid pouring inlet 64 of the liquid housing body 30, and thus the pouring operation of the ink becomes easy.

(5) In a case where the liquid housing body 30 has the visible recognition portion 68 that can visibly recognize the remaining amount of the ink in the inside of the liquid housing chamber 55, whether or not the pouring operation of the ink is needed is easily determined by the remaining amount of the ink being visibly recognized through the transparent window 23 of the front surface side wall 14*a* and the visible recognition portion 68 of the liquid housing body 30 from the outside of the casing 14.

(6) Since the ink absorption material 71 restricts the ink leaked at the time of pouring operation of the ink from flowing to the rear side of the transparent window 23 of the front surface side wall 14*a*, contamination of the transparent window 23 or contamination of the visible recognition portion 68 of the liquid housing body 30 by the ink leaked is reduced.

(7) When the cover member 93 is operated so as to release the sealed state of the air introduction portion 92 after the ink bottle 90 is supported in the cover member 26 in the opening position in a state where the pouring of the ink to the liquid pouring inlet 64 can be performed, the air from the air introduction portion 92 is introduced in the inside of the ink bottle 90. For this reason, even if pressure is not applied to the ink bottle 90 from the outside, the ink from the pouring outlet portion 90*a* is likely to be poured out, and pouring times of the ink to the liquid housing body 30 can be reduced.

Second Embodiment

Next, a printing apparatus 12 of the second embodiment will be described. In the printing apparatus 12 of the present embodiment, a portion of the configuration of an ink bottle being a liquid pouring member and the configuration of the engaging mechanism that engages with the cover member 26 is different from the construction of the first embodiment and other configurations are substantially the same as the first embodiment. For this reason, hereinafter, the configurations that are different from the first embodiment will be described, the other configurations has the same reference numerals and a redundant description is omitted.

Figure 5:
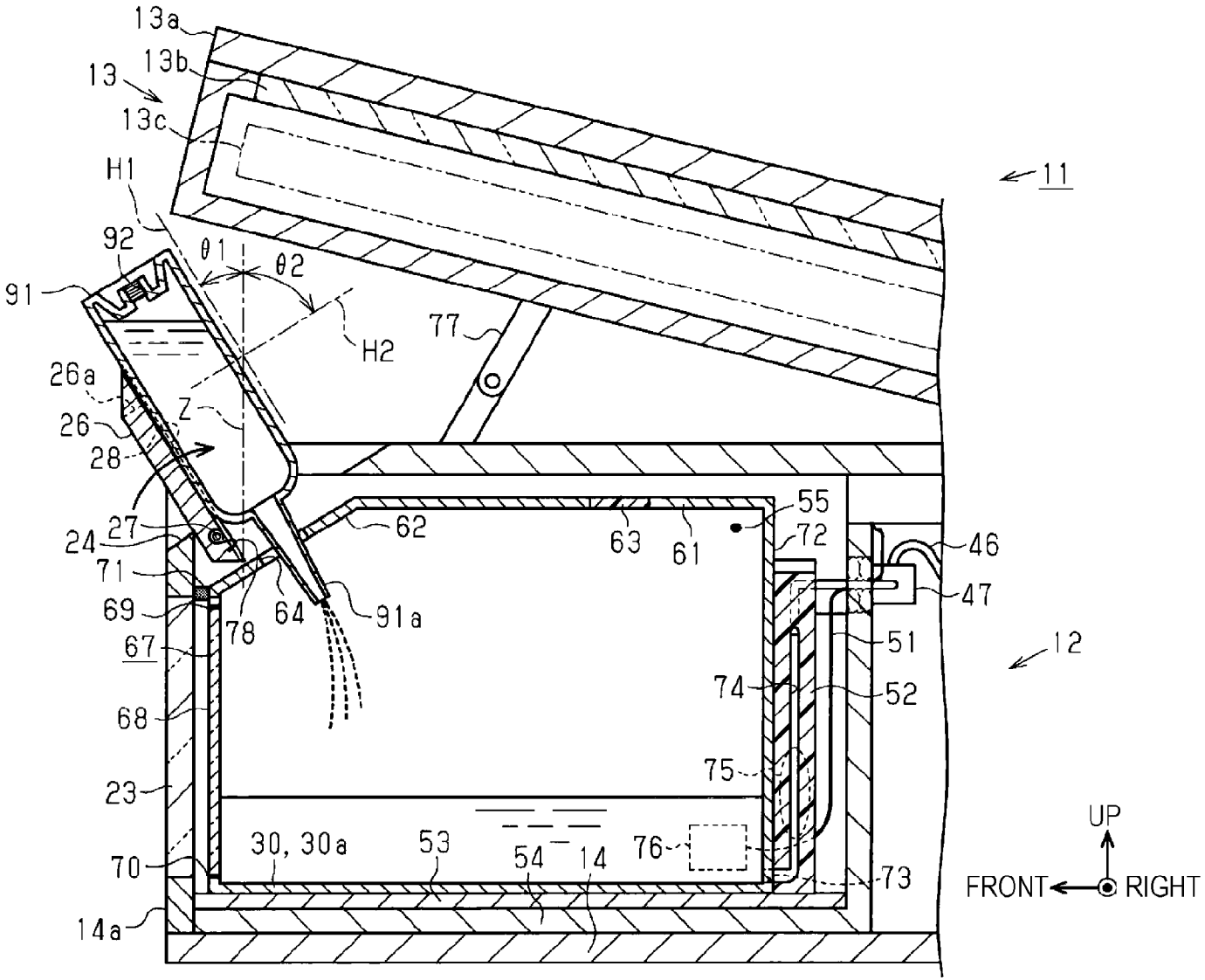
FIG. 5 is a partial sectional view when liquid is poured to the liquid housing body in a printing apparatus of a second embodiment.

As illustrated in FIG. 5, in the present embodiment different from the first embodiment, an engaging member 66 having a rod shape that extends toward the lateral direction in parallel with a rotating shaft 27 is not provided in the position between the rotating shaft 27 in the position being a rear side of the cover member 26 being the closing position and the liquid pouring inlet 64 in the inside of a casing 14. For this reason, as illustrated in FIG. 5, the cover member 26 rotates to be displaced from the closing position toward the opening position by the user is restricted from being rotated to be displaced to more opened direction by a portion of the surface side of the cover member being engaged with a portion of upper side (that is, a portion being lower end of the inclined portion 24) of the transparent window 23 in the front surface side wall 14*a* of the casing 14. At this point, the portion of the upper side of the transparent window 23 in the front surface side wall 14*a* of the casing 14 functions as an engaging mechanism that engages to the cover member 26 in a method capable of restricting the cover member 26 from displacing from the opening position to a further opening position.

In addition, in a case of the invention, a torsion spring 78 which is as an example of a biasing member is mounted on the rotating shaft 27 which is a rotation center of the cover member 26. The torsion spring 78 has a pair of arms. An arm of the pair of the arms is engaged to a portion of the casing 14 and the other arm is engaged to the proximal end portion (a end portion opposite to a distal end portion on which a finger hook portion 26*a* is formed viewed from the rotating shaft 27) in the cover member 26. Accordingly, as illustrated by a solid arrow in FIG. 5, the cover member 26 is normally biased form the opening position to the closing position by biasing force of the torsion spring 78.

As described in FIG. 5, the magnitude of the biasing force of the torsion spring 78 in this case is set so as to be value that is smaller than a magnitude of moment added in the clockwise direction from the ink bottle 91 about the cover member 26 in which the ink bottle 91 filled with ink is supported. On the other hand, the ink bottle 91 in which the ink amount is reduced by half by proceeding the pouring operation of the ink is set so as to be value that is greater than a magnitude of moment added in the clockwise direction from the ink bottle 91 about the cover member 26 in which the ink bottle 91 filled with ink is supported.

So then, in the printing apparatus 12 of the present embodiment, hereinafter, an action in a case where the ink is poured from the liquid pouring inlet 64 using the ink bottle 91 which is an example of the liquid pouring member in the inside of the liquid housing chamber 55 of the liquid housing body 30 is described. The ink bottle 91 of the present embodiment is different from the ink bottle 90 of the first embodiment, and the rib shape of a stopper portion is not formed around the elongate pouring outlet portion 91*a* in the distal end portion of the ink bottle 91.

Now, as illustrated in FIG. 5, at the time of the pouring of the ink, the cover member 26 rotates to be displaced from the closing position toward the opening position against the biasing force of the torsion spring 78, and a portion of the surface side of the cover member is engaged with a portion of upper side of the transparent window 23 in the front surface side wall 14*a* of the casing 14. Accordingly, on the rear surface (surface that faces obliquely upward in FIG. 5) of the cover member 26 in this state, the ink bottle 91 filled with the ink for pouring is supported in a state where a circumferential surface of the body portion is engaged with the concave groove 28 formed on the rear surface of the cover member 26. Then, since the side of the rotation moment applied from the ink bottle 91 filled with the ink is greater than the biasing force of the torsion spring 78, the cover member 26 is held at the opening position.

Accordingly, from this state, when the ink bottle 91 is slid diagonally downward along the concave groove 28 of the rear surface of the cover member 26, the pouring outlet portion 91*a* of the ink bottle 91 is inserted into the liquid pouring inlet 64 of the liquid housing body 30 (30*a*). Then, the ink bottle 91 pours the ink into the inside the liquid housing chamber 55 of the liquid housing body 30 (30*a*) at the inclined posture that the pouring outlet portion 91*a* in the distal end portion of the ink bottle 91 faces the inclined lower side. Accordingly, when the ink pouring proceeds from this state, the ink amount in the inside of the ink bottle 91 is gradually decreased.

Figure 6:
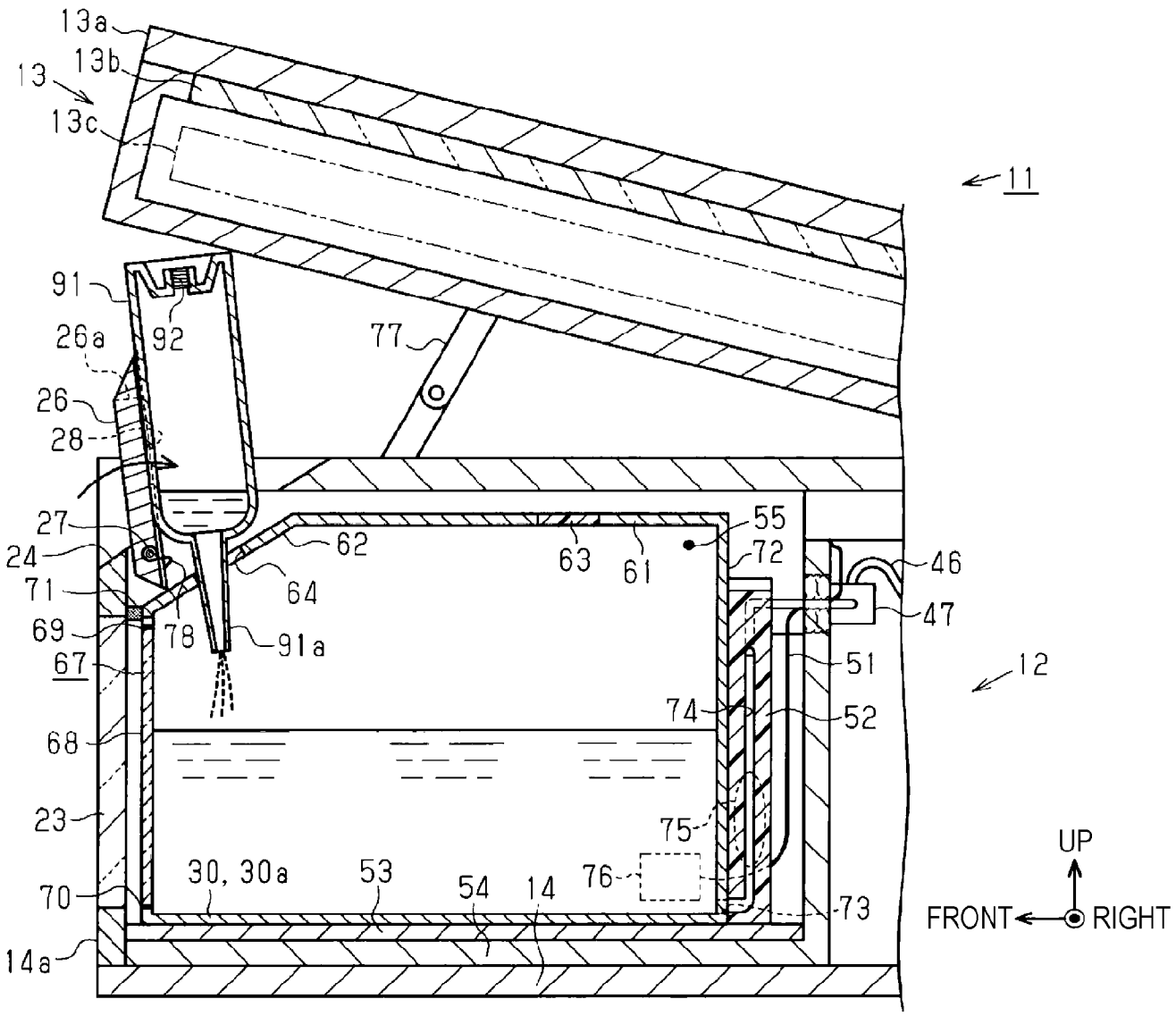
FIG. 6 is a partial sectional view in a case where an operation in which liquid is further poured to a liquid housing body in a printing apparatus from a state of FIG. 5.

Then, as illustrated in FIG. 6, along with the reduction of the amount of the ink, the magnitude of the rotating moment in the clockwise direction added to the cover member 26 from the ink bottle 91 supported to the cover member 26 in the opening position is gradually decreased, and thus the side of the biasing force of the torsion spring 78 at which the amount of the ink is reduced by half is greater than the magnitude of the rotating moment. Therefore, the cover member 26 is started the rotation displacement to the closing position. In other words, a portion of a surface of the cover member 26 is spaced apart from a portion of the upper side of the transparent window 23 in the front surface side wall 14*a* of the casing 14, and by the biasing force of the torsion spring 78, as illustrated by a solid arrow in FIG. 5, the cover member 26 is displaced to the closing position. As a result, the posture the ink bottle 91 supported to the cover member 26 is changed from a posture in which the distal end of the ink bottle faces the inclined lower side to a perpendicular posture in which the distal end directly faces the beneath thereof and thus the pouring of the ink to the liquid housing chamber 55 is prompted.

According to the printing apparatus 12 of the second embodiment described below, the following effects can be further obtained in addition to the effects of (1) to (7) according to the first embodiment.

(8) Since the cover member 26 is biased to the closing position direction by the biasing force of the torsion spring 78, there is a concern that the cover member 26 in the closing position is carelessly opened.

(9) When the pouring of the ink to the liquid housing body 30 from the ink bottle 91 supported to the cover member 26 in the opening position proceeds and thus the ink amount in the inside of the ink bottle 91 is reduced, since the weight of the ink bottle 91 is reduced along with the reduction of the amount of ink, the cover member 26 is displaced in the direction of the closing position by the biasing force of the torsion spring 78. Then, the posture the ink bottle 91 supported to the cover member 26 is changed from a posture in which the distal end of the ink bottle faces the inclined lower side to a perpendicular posture in which the distal end directly faces the beneath thereof. As a result, regardless of the quantity of the amount of ink in the ink bottle 91, the ink can be immediately poured from the ink bottle 91 to the liquid housing body 30.

Third Embodiment

Next, a printing apparatus 12 of the third embodiment will be described. In the printing apparatus 12 of the present embodiment, a portion of the configuration of an ink bottle being a liquid pouring member and the configuration of the engaging mechanism that engages with the cover member 26 is different from the construction of the first embodiment and other configurations are substantially the same as the first embodiment. For this reason, hereinafter, the configurations that are different from the first embodiment will be described, the other configurations has the same reference numerals and a redundant description is omitted.

Figure 7:
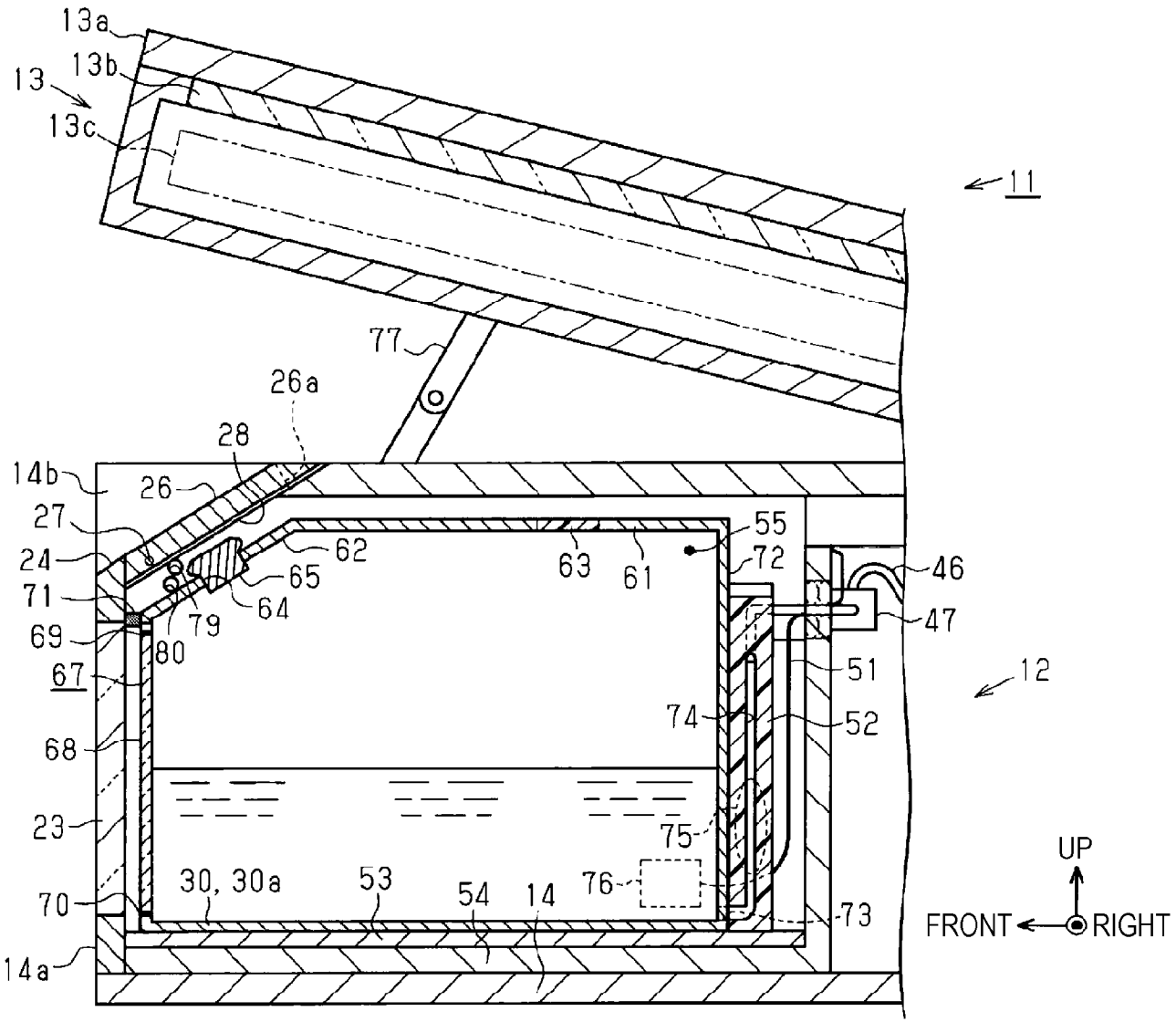
FIG. 7 is a partial sectional view of a liquid supply unit in a printing apparatus of a third embodiment.

As illustrated in FIG. 7, in the present embodiment different from the first embodiment, an engaging member 66 having a rod shape that extends toward the lateral direction in parallel with a rotating shaft 27 is not provided in the position a rear side of the cover member 26 being the closing position in the inside of a casing 14. Instead of this, the engaging hole 79 which has the lateral direction as a depth direction is formed in a position to which the engaging member 66 according to the first embodiment is provided and in substantially the same position in the vertical direction and in the lateral position in the side surface portion 14*b* of vertical to be orthogonal to the inclined portion 24 at the side direction of the inclined portion 24 in the casing 14. In addition, the engaging hole 80 having the same shape as that of the engaging hole 79 is formed in position which is the clockwise direction about the rotating shaft 27 than the engaging hole 79 in the area through which the proximal end portion of the cover member 26 at the time of rotating of the cover member 26. Accordingly, the engaging pin 81 (see FIG. 8 and FIG. 9) that has a predetermined length and rigidity is inserted in the engaging holes 79, 80.

So then, in the printing apparatus 12 of the present embodiment, hereinafter, an action in a case where the ink is poured from the liquid pouring inlet 64 using the ink bottle 91 which is an example of the liquid pouring member in the inside of the liquid housing chamber 55 of the liquid housing body 30 is described. The ink bottle 91 of the present embodiment is different from the ink bottle 90 of the first embodiment, and the rib shape of a stopper portion is not formed around the elongate pouring outlet portion 91*a* in the distal end portion of the ink bottle 91.

Figure 8:
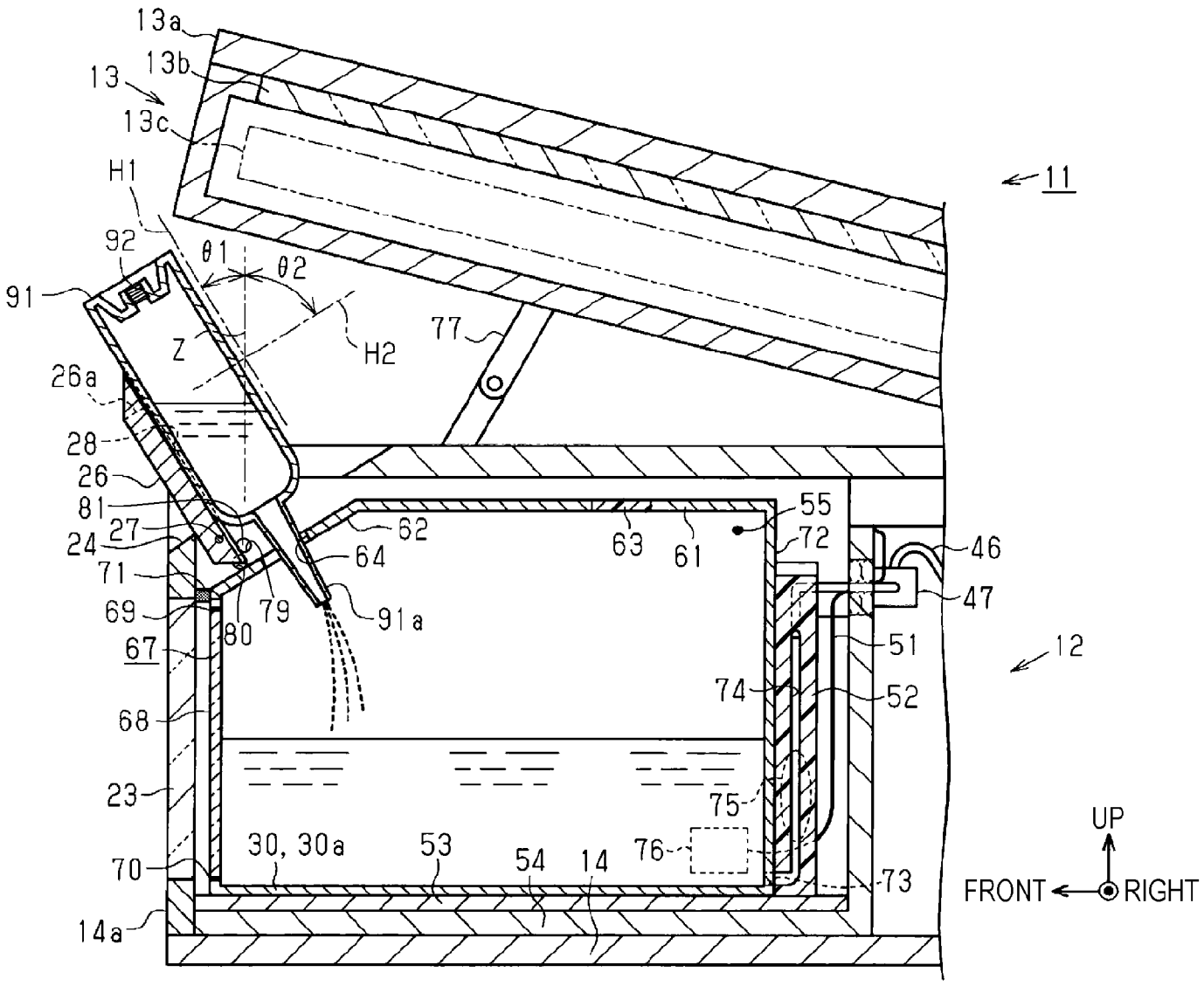
FIG. 8 is a partial sectional view when liquid is poured to a liquid housing body in the printing apparatus of the third embodiment.

Now, as illustrated in FIG. 8, an end of the engaging pin 81 is inserted in the engaging hole 79 formed at the position which is the most counterclockwise direction position about the rotating shaft 27, among the plurality of the engaging holes 79, 80 at the time of the pouring of the ink. Then, the other end side of the engaging pin 81 extends in the inside of the area through which the proximal end portion pass at the time of rotating of the cover member 26. Then, when the cover member 26 is rotated to be displaced from the closing position to the opening position in this state, as illustrated in FIG. 8, the proximal end portion of the cover member 26 is engaged to the engaging pin 81 in the opening position and a rotating displacement of the cover member 26 to a more open direction is restricted. Accordingly, the cover member 26 is held at a stable opening position by engaging with the engaging pin 81. At this point, the engaging pin 81 in which the other end side thereof engages with the cover member 26 in a state where an end thereof is inserted in an engaging hole 79 (or an engaging hole 80) functions as an engaging mechanism that engages to the cover member 26 in a method capable of restricting the cover member 26 from displacing from the opening position to a further opening position.

Then, as in the first embodiment, an ink bottle 91 that is an example of the liquid pouring member in which ink for pouring is stored is disposed on the rear surface (the surface facing the inclined upper side in FIG. 8) of the cover member 26. In addition, in that case, the ink bottle 91 is slid to be moved obliquely downward, in a state where the body portion is engaged with the concave groove 28 of the rear surface of the cover member 26. Then, as illustrated in FIG. 8, the ink bottle 91 pours the ink into the inside the liquid housing chamber 55 of the liquid housing body 30 (30*a*) at the inclined posture that the pouring outlet portion 91*a* in the distal end portion of the ink bottle 91 faces the inclined lower side.

In addition, when the open angle at the opening position of the cover member 26 is changed, at this time the engaging pin 81 is removed from the engaging hole 79 in which the engaging pin 81 is inserted and then the engaging pin 81 may be inserted into the engaging hole 80. In other words, the open angle of the cover member 26 cab be different from each other for each position in which a plurality of engaging holes 79 and 80 have been formed.

Figure 9:
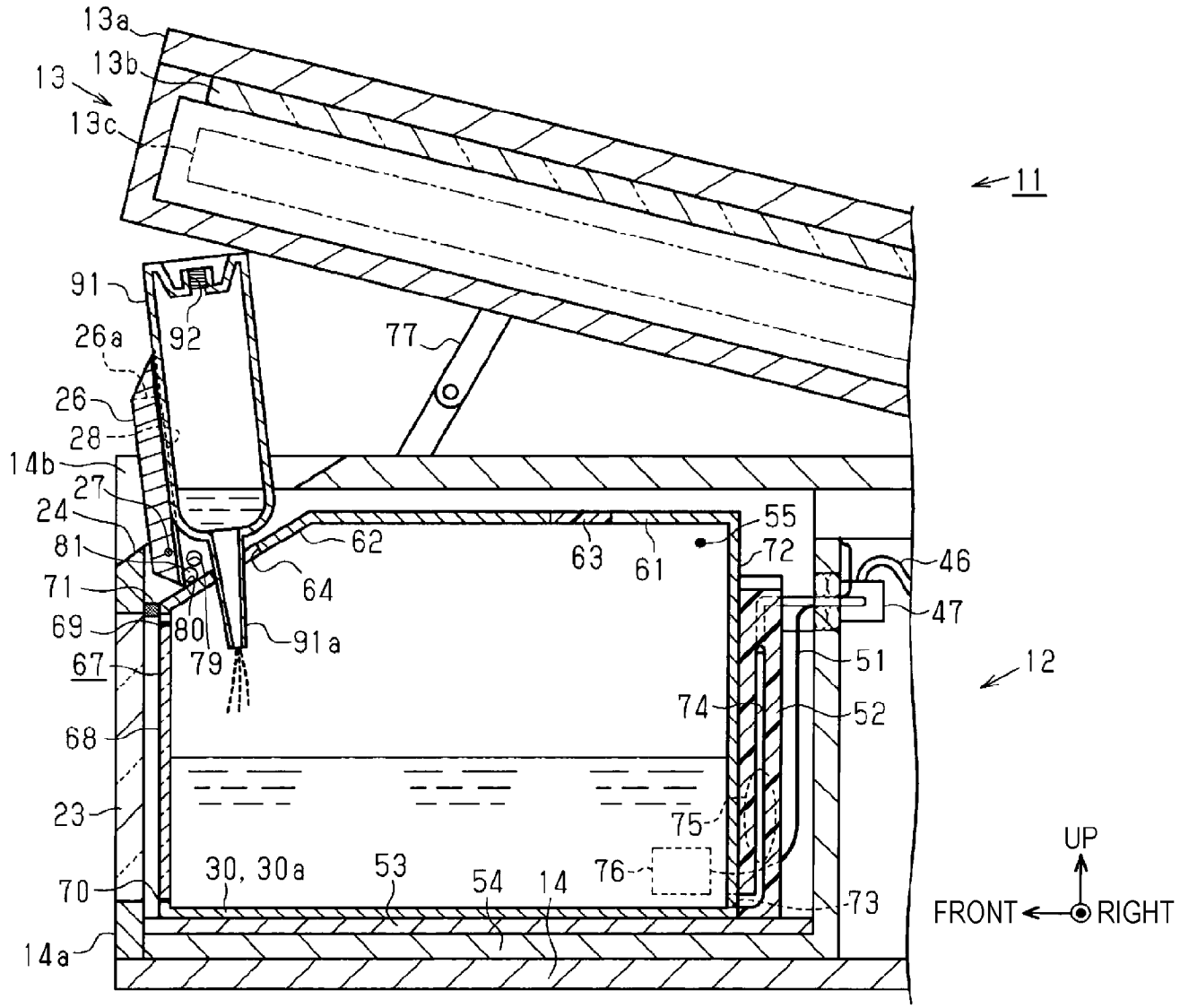
FIG. 9 is a partial sectional view in a case where an open angle of the cover member is different from the state of FIG. 8.

As illustrated in FIG. 9, when the open angle of the cover member 26 is smaller than that of the state in FIG. 8, the engaging pin 81 is inserted into the engaging hole 80 that positions in the clockwise direction about the rotating shaft 27 other than the engaging hole 79. Then, when the cover member 26 is rotated to be displaced from the closing position in the open direction, the cover member 26 is in contact with the engaging pin 81 while the open angle is small (that is, In the early hours from the start of the rotation displacement), than that of the case in FIG. 8 in which the engaging pin 81 is inserted into the engaging hole 79. For this reason, the rotational displacement to more open direction at the opening position having the small open angle is restricted. Accordingly, as illustrated in FIG. 9, the ink bottle 91 can be supported at a more nearly vertical attitude than that of state in FIG. 8.

According to the printing apparatus 12 of the third embodiment described below, the following effects can be further obtained in addition to the effects of (1) to (7) according to the first embodiment.

(10) Since the opening position of the cover member 26 can be selected from the plurality of the opening positions by the determination of the user, the pouring operation of the ink can be efficiently performed according to the working circumstance.

The embodiment may be modified as follows. In addition, a modification example shown in the following may be one or a combination of plurality of modification examples.

Figure 10:
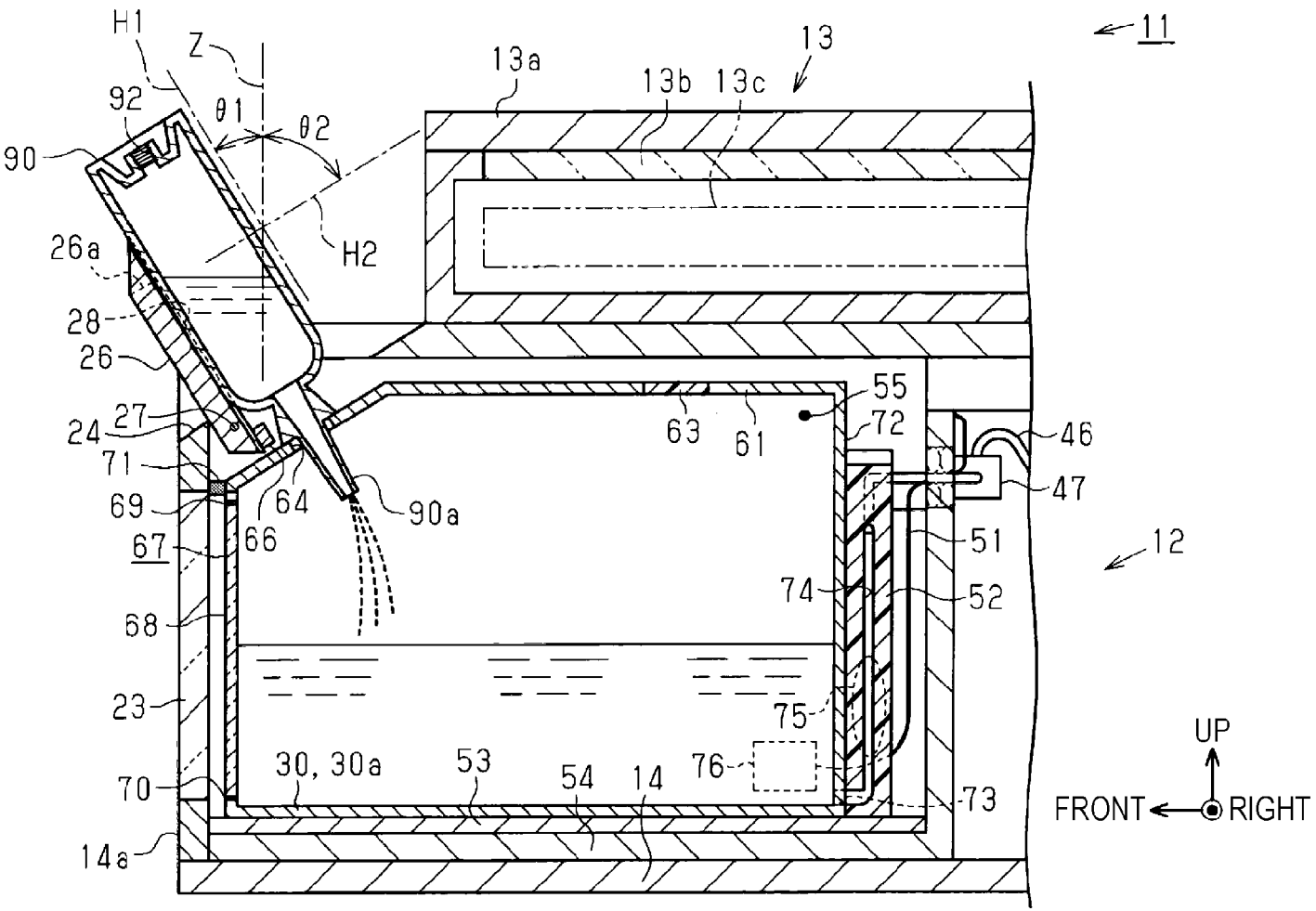
FIG. 10 is a partial sectional view when liquid is poured to a liquid housing body in the printing apparatus of a modification example.

As illustrated in FIG. 10, in the printing apparatus 12, the upper side area of the inclined portion 24 on which the cover member 26 is provided may be not covered by the image reading device 13 and may be opened so that the cover member 26 can be operated in order to normally open and close the cover member 26. According to this configuration, even if a front portion of the image reading device 13 is not raised, since the cover member 26 can be rotated to be displaced from the closing position to the opening position and the pouring operation of the ink can be easily performed, the usability is more improved.

In the modification example of FIG. 10 as the first embodiment and the third embodiment, as in the second embodiment, the cover member 26 may be biased in the direction of the closing position by the biasing member such as the torsion spring 78.

An ink absorption material 71 provided between the upper side position of the transparent window 23 in the front surface side wall 14*a* of the casing 14 and the upper side position of the visible recognition portion 68 in front wall portion 67 of the liquid housing bodies 30*a* to 30*d* may not is in contact with the rear surface of the front surface side wall 14*a* of the casing 14. In brief, the ink absorption material 71 is provided on the upper position of the visible recognition portion 68 in the front wall portion 67 of the liquid housing bodies 30*a* to 30*d* and thus may restrict the ink from flowing down of the position of the ink absorption material. In addition, the ink absorption material 71 may not necessarily provided.

The transparent window 23 may not be provided in the front surface side wall 14*a* of the casing 14. In addition, in that case, the side wall portion may be configured of an opening/closing door instead of the transparent window 23.

In the third embodiment, the engaging holes 79 and 80 in which the engaging pin 81 is inserted may be only one engaging hole.

An engaging mechanism that can engage in the plurality of the opening position in which the angle θ1 between the cover member 26 and the vertical line Z is different from each other may be other structures such as the other end of a swing lever of which one end is supported to the cover member 26 in a rotatable manner disengaging from the plurality of the engaging portions provided to the casing 14 side in addition to a configuration aligned of the plurality of the engaging holes 79 and 80 and the engaging pin 81.

In a case where the cover member 26 is in the opening position, an angle θ1 between the surface that supports the ink bottles 90 and 91 and the vertical line Z and an angle θ2 between the surface that forms the liquid pouring inlet 64 in the liquid housing body 30 in a state housed in the inside of the casing 14 and the vertical line Z may not be in relation supplementary angle to each other. However, it is preferable that the angle θ1+angle θ2<180 degrees.

In the second embodiment, the biasing member that biases the cover member 26 into the direction of the closing position may be a biasing member of other configurations such as a tension coil spring, a compression coil spring and elastic pieces in addition to the torsion spring 78. In addition, the size of the biasing force of the biasing member such as the torsion spring 78 may be set to be smaller than the magnitude of the rotational moment based on the weight of the liquid pouring member itself such as ink bottle 90 and 91 (that is, a hollow type)

In the first embodiment and the third embodiment, the portion that the cover member 26 engages with the engaging mechanism (the engaging member 66, the engaging pin 81) may be any one of rear surface side and surface side, and the portion in addition to the proximal end portion may have an engaging configuration.

The holding portion formed to the rear surface of the cover member 26 may be configured with a V groove, a plurality of projections, a convex and concave surface, a rough surface in which frictional resistance is high, or the like in addition to the concave groove 28. In brief, in a case where the cover member 26 is in the opening position, if the ink bottle (liquid pouring member) 90 and 91 mounted on the rear surface can be held configurable in the alignment state in the liquid pouring inlet 64, for example, it may be a plane with an adhesive.

The body portion of the liquid pouring member is not limited into a cylindrical ink bottle 90 and 91, and the body portion may be an ink bottle having another shape such as a Rectangular tube shape or a spherical shape. In addition, the cover member 93 is not removed from the air introduction portion 92, the mounted state of the cover member is loosened, and thus it may be a configuration capable of releasing the sealing of the air introduction portion 92. Further, the air introduction portion 92 is not limited to the female screw hole and may be a common hole, and the cover member 93 may be, for example, a rubber plug and does not have the male screw portion in that case.

The printing apparatus 12 may be a dot impact printer or a laser printer as long as it can be printed on the medium. In addition, the printing apparatus 12 may be a single configuration with only printing functions, or may be not included in the multifunction apparatus. Further, the printing apparatus 12 is not limited to a serial printer, it may be a line printer or a page printer.

In each embodiment described above, the printing apparatus 12 can be used ink of four colors. However, ink of only one color may be used, and ink of two colors, three colors, or five colors may be used. The number of the liquid housing chamber 55 or the number of the liquid supply tube 46 or the like may correspond the number of the color of the ink to be used.

The liquid housing body 30 may be formed for each color of the ink independently, and the liquid housing body 30 of the plurality of the colors (it may be all colors) may be integrally formed and thus may become a body.

A medium can employ Vegetable paper, resin films, metal foils, metal films, composite film (laminate film) of plastic and metal, fabrics, nonwovens, various ones such as a ceramic sheet.

The member that supports the liquid pouring member may be a support member that is provided in the casing and is not limited to the cover member 26 that covers the liquid housing body 30, or the liquid pouring inlet 64.

In the embodiment described above, the printing apparatus 12 may be a liquid ejection device that ejects or discharges the other liquid in addition to the ink. The state of the liquid ejected as very small amount of droplets from the liquid ejection device includes grains, tears, and also those pulling the tail to filamentous. In addition, the liquid referred to herein may be any material that can be ejected from the liquid ejection device. For example, as long as it may be in the state when material is a liquid, high or low liquid viscosity of liquid material, the sol, gel water, other inorganic solvents, organic solvents, solutions, liquid resins, a fluid material including a liquid metal (metal melt). Further, particles of functional material made of liquid, pigment, solid material such as metal particles or the like as one state of matter is dissolved in a solvent, dispersed, mixed or the like. Representative examples of the liquid include ink, a liquid crystal or the like as described in the above embodiments. Here, the ink includes various liquid compositions such as general water-based ink, oil-based ink, gel ink, and hot melt ink.

The entire disclosure of Japanese Patent Application No. 2015-157978, filed Aug. 10, 2015 is expressly incorporated by reference herein.

What is claimed is:

1. A printing apparatus, comprising:

a printing unit that performs printing onto a medium using liquid;

a liquid housing body that includes a liquid pouring inlet that is capable of pouring the liquid into a liquid housing chamber; and a casing in which the printing unit and the liquid housing body are housed, wherein the casing includes a support member that is capable of supporting a liquid pouring member in which the liquid is stored in a state where the liquid is capable of being poured from an inside of the liquid pouring member to the liquid pouring inlet of the liquid housing body.

2. The printing apparatus according to claim 1, wherein an engaging mechanism is provided on the casing, the engaging mechanism engaging the support member or a cover member so that the support member or the cover member displaced from a closing position to an opening position is capable of being restricted from being displaced in a further opening direction from the opening position.

3. The printing apparatus according to claim 2, wherein the engaging mechanism is configured to be capable of engaging the support member or the cover member at a plurality of opening positions in which an angle to a vertical line varies.

4. The printing apparatus according to claim 1, further comprising:

a biasing member that biases the support member or a cover member from an opening position in a closing position direction.

5. The printing apparatus according to claim 1, wherein an angle between a surface which supports the liquid pouring member and a vertical line in a case where the support member or a cover member is in an opening position and an angle between a surface on which the liquid pouring inlet in the liquid housing body which is in a state of being housed in the casing is formed and the vertical line are in a relationship of a complementary angle.

6. The printing apparatus according to claim 1, wherein the liquid pouring member includes a pouring outlet portion for pouring out the liquid to the liquid pouring inlet, an air introduction portion for introducing air that is provided to a side opposed to a side on which the pouring outlet portion is provided, and a cover member that is capable of sealing the air introduction portion and is operated to release sealing of the air introduction portion when the liquid is poured out to the liquid pouring inlet.

7. A printing apparatus, comprising:

a printing unit that performs printing onto a medium using liquid;

a liquid housing body that includes a liquid pouring inlet through which the liquid is capable of being poured into a liquid housing chamber; and a casing in which the printing unit and the liquid housing body are housed, wherein the casing includes a cover member that is capable of displacing a position thereof between an opening position which exposes at least a portion of the liquid housing body and a closing position which does not expose the same at least a portion of the liquid housing body, and wherein the cover member is capable of supporting a liquid pouring member in which the liquid is stored in a state where the liquid is capable of being poured from an inside of the liquid pouring member to the liquid pouring inlet of the liquid housing body in a case where the cover member is in the opening position.

8. The printing apparatus according to claim 7, wherein the cover member has a configuration of being capable of displacing the position thereof between the opening position which exposes the liquid pouring inlet to an outside and the closing position that does not expose the liquid pouring inlet to the outside.

9. The printing apparatus according to claim 8, wherein a holding portion is provided on the cover member, a holding member being capable of holding the liquid pouring member on the cover member in a state where the liquid pouring member is aligned with the liquid pouring inlet in a case where the cover member is in the opening position.

10. The printing apparatus according to claim 7, wherein a transparent window is provided on a side wall that is positioned on a low side of the cover member in the casing, the transparent window through which the liquid housing body housed in the inside of the casing is capable of being visibly recognized.

11. The printing apparatus according to claim 10, wherein a flow restricting unit is provided in a position that is higher than that of the transparent window in the side wall, the flow restricting unit restricting the liquid from flowing downwardly in a vertical direction.

* * * * *